US009578964B2

(12) United States Patent
Pell

(10) Patent No.: US 9,578,964 B2
(45) Date of Patent: Feb. 28, 2017

(54) COMPACT MULTIPURPOSE FURNITURE PIECE

(71) Applicant: Mark D. Pell, Lancaster, PA (US)

(72) Inventor: Mark D. Pell, Lancaster, PA (US)

( * ) Notice: Subject to any disclaimer, the term of this patent is extended or adjusted under 35 U.S.C. 154(b) by 0 days.

(21) Appl. No.: 15/018,471

(22) Filed: Feb. 8, 2016

(65) Prior Publication Data

US 2016/0227926 A1 Aug. 11, 2016

Related U.S. Application Data

(60) Provisional application No. 62/114,180, filed on Feb. 10, 2015.

(51) Int. Cl.

| | |
|---|---|
| ***A47B 85/00*** | (2006.01) |
| ***A47B 83/04*** | (2006.01) |
| ***A47B 96/02*** | (2006.01) |
| ***F21V 33/00*** | (2006.01) |
| ***F21V 23/00*** | (2015.01) |
| ***F21V 1/00*** | (2006.01) |
| *F21W 131/301* | (2006.01) |

(52) U.S. Cl.

CPC ..... *A47B 83/04* (2013.01); *A47B 96/021* (2013.01); *F21V 1/00* (2013.01); *F21V 23/002* (2013.01); *F21V 33/0012* (2013.01); *F21W 2131/301* (2013.01)

(58) Field of Classification Search

CPC ..... A47B 83/04; A47B 96/021

USPC . 108/23, 56, 26; 211/36, 34, 27, 28, 29, 30, 211/31, 32, 33

See application file for complete search history.

(56) References Cited

U.S. PATENT DOCUMENTS

| | | | | | |
|---|---|---|---|---|---|
| 390,076 | A | * | 9/1888 | Granbery | A47B 13/12 108/23 |
| 409,154 | A | * | 8/1889 | Kintz | A47B 13/12 108/23 |
| 498,173 | A | * | 5/1893 | Kraushaar | A47B 13/12 108/23 |
| 926,426 | A | * | 6/1909 | Koch | F16M 11/12 108/23 |
| 1,433,370 | A | * | 10/1922 | Goldsmith | F21V 33/00 108/23 |
| 1,439,668 | A | * | 12/1922 | Goodfield | F21V 33/00 211/1 |
| 1,547,103 | A | * | 7/1925 | Dindinger | A47G 29/00 108/23 |
| 1,898,666 | A | * | 2/1933 | Isaacson | A47B 23/04 108/23 |

(Continued)

*Primary Examiner* — Jose V Chen

(57) ABSTRACT

A base, elongated member, and illumination source are combined to form the core of an organizational unit. The base has a first support structure and second support structure which serve as legs. These support a tabletop, as well as a shelf which is used to hold footwear or other items. The shelf is perforated in order to allow for drainage and prevent moisture accumulation, enhancing drying of items placed on the shelf. The elongated member is a height-adjustable pole connected on top of the tabletop, with the illumination source being placed at the top of the elongated member. A locking mechanism is provided for the elongated member, the elongated member itself being divided into a sleeve connected to the tabletop and a post that slides into and out of the sleeve. One or more hooks and an accessory receptacle may be attached to the elongated member.

5 Claims, 9 Drawing Sheets

(56) References Cited

U.S. PATENT DOCUMENTS

| | | | | | |
|---|---|---|---|---|---|
| 2,261,514 | A * | 11/1941 | Dunigan | A47B 37/00 | 108/23 |
| 2,480,233 | A * | 8/1949 | Fuller | A47B 23/046 | 108/23 |
| 2,748,262 | A * | 5/1956 | McCrea | F21V 33/00 | 108/23 |
| 6,367,749 | B2 * | 4/2002 | Valiulis | A47B 91/00 | 211/190 |
| 6,450,106 | B2 * | 9/2002 | McIntyre | A47F 5/04 | 108/23 |
| 6,939,502 | B2 * | 9/2005 | Lyden | A43B 3/0063 | 12/146 B |
| 8,393,482 | B2 * | 3/2013 | Durham | A47L 23/205 | 211/182 |
| 8,567,615 | B1 * | 10/2013 | Rainey | A47B 61/04 | 108/193 |
| 2004/0179354 | A1 * | 9/2004 | Chen | F21V 33/0012 | 362/154 |
| 2005/0161419 | A1 * | 7/2005 | Lawson | A47B 57/04 | 211/189 |
| 2015/0083678 | A1 * | 3/2015 | Baughman | G09F 15/0056 | 211/85.3 |
| 2016/0066731 | A1 * | 3/2016 | Afolabi | A47G 25/84 | 211/36 |

* cited by examiner

COMPACT MULTIPURPOSE FURNITURE PIECE

The current application claims a priority to the U.S. Provisional Patent application Ser. No. 62/114,180 filed on Feb. 10, 2015.

FIELD OF THE INVENTION

The present invention relates generally to an organizational unit that compactly addresses a number of basic home needs, including lighting and convenient storage of apparel.

BACKGROUND OF THE INVENTION

A variety of organizational storage units are individual units such as coat racks, storage bowls for keys or any other small items, shoe racks, and so on. Typically, these organizational storage units require a light nearby to illuminate the organizational storage unit in order to see the contents properly. There are, however, organizational storage units which feature a combination of organizational storage units so that an individual does not need to move from one place to another in his or her home when leaving or entering the home. The main issue with these organizational storage units which combine a few individual organizational storage units is the amount of space required within a home. If an individual has limited space, these convenient organizational storage units are not feasible to place in the home.

The present invention serves to solve these problems, create an efficient organizational unit, and serve as a decorative piece for a home. The present invention helps to reduce clutter and keeps a home cleaner. The present invention also increases lighting in a home and prevents dirt or other items from getting into the home (when the placed near an entrance). Furthermore, a combination use of space is created by integrating several units together, the several units being easily assembled thanks to a modular construction.

DETAIL DESCRIPTIONS OF THE INVENTION

All illustrations of the drawings are for the purpose of describing selected versions of the present invention and are not intended to limit the scope of the present invention.

The present invention is a compact multipurpose furniture piece that makes an efficient use of space, especially desirable for areas with limited free space. Components of the present invention allow it to be used for a number of purposes, a few examples including a shoe rack, an umbrella stand, and a key drawer.

Figure 7:
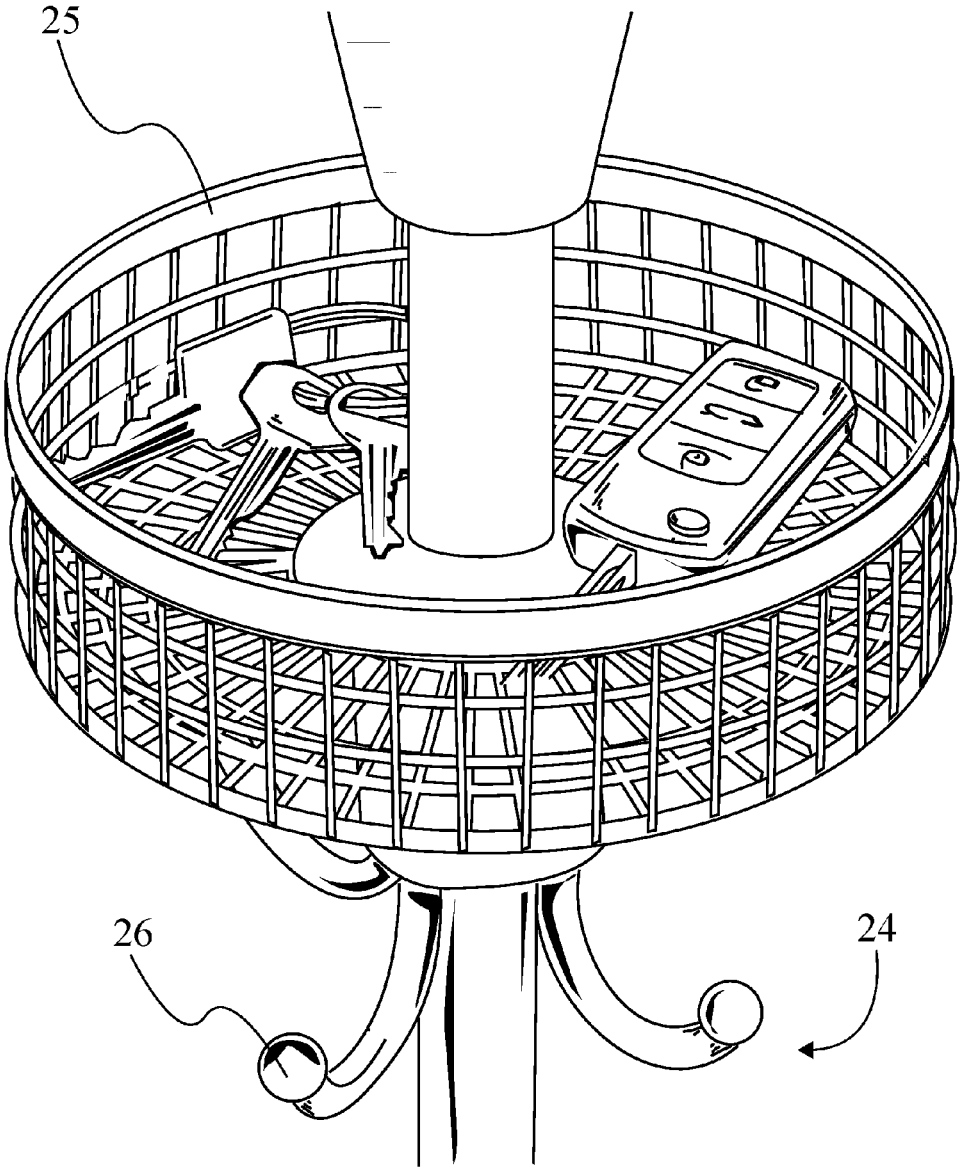
FIG. 7 is an illustration showing an accessory container of the present invention.
Figure 8:
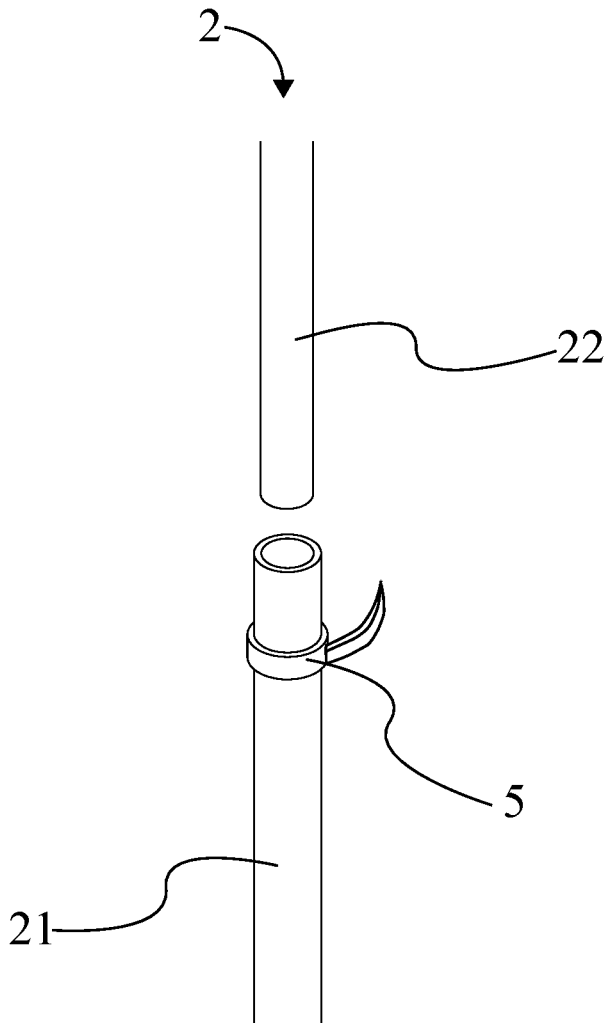
FIG. 8 is an illustrating showing a telescoping engagement of an elongated member of the present invention.

To support the above, the present invention comprises a base 1, an elongated member 2, and an illumination source 3. The base 1 supports the rest of the invention, for example by being placed on a floor or other flat surface. The elongated member 2 allows additional components to be mounted to the present invention, and also serves to elevate the illumination source 3 above the base 1. This general arrangement is illustrated in FIG. 1-FIG. 5. Specific components are independently illustrated in FIG. 6-FIG. 8.

The base 1 itself comprises a first leg structure 11, a second leg structure 12, a tabletop 13, and an at least one shelf 14. The elongated member 2, which is positioned above the base 1, is connected adjacent to and normal to the tabletop 13. The illumination source 3 is adjacently attached to the elongated member 2; in the preferred embodiment, the illumination source 3 is positioned opposite the tabletop 13 along the elongated member 2. The elongated member 2 thus effectively serves as a pole for the illumination source 3. The first leg structure 11 and the second leg structure 12 support and elevate the rest of the present invention; the first leg structure 11 and the second leg structure 12 are each adjacently connected to the tabletop 13. The elongated member 2 is positioned opposite the two leg structures through the tabletop 13, with the leg structures serving as the bottom of the present invention. Preferably, to provide maximal support, the first leg structure 11 and the second leg structure 12 are positioned at a left side and a right side of the tabletop 13. That is, the first leg structure 11 and the second leg structure 12 are positioned opposite each other along the tabletop 13. To provide additional storage, especially suitable for footwear (as detailed later), the at least one shelf 14 is connected between the first leg structure 11 and the first leg structure 11. The at least one shelf 14 is offset from the tabletop 13, with the at least one shelf 14 being below the tabletop 13. This creates an area between the at least one shelf 14 and the tabletop 13 where items can be placed.

Potentially, to allow for an external power source to be used to power the illumination source 3, the present invention may comprise a power cord 4. The power cord 4 traverses into the elongated member 2 and is electrically connected to the illumination source 3. Routing the power cord 4 through the elongated member 2 in such a manner is advantageous as it helps to reduce clutter and maintain a clean look. Alternatively, or in addition to the power cord 4, an internal power source may be provided for the illumination source 3. For example, a battery may be housed in the base 1 structure and electrically connected to the illumination source 3. This allows the present invention to be placed, for example, where a power outlet is not easily accessible.

Regardless of whether an external power source (e.g. in conjunction with the power cord 4) or an internal power source (e.g. the battery) is used, an illumination switch can be incorporated into the present invention. The illumination switch is electrically connected between a power source (e.g. through the power cord 4) and the illumination source 3; as a result, closing or opening the illumination switch completes or breaks said electrical connection. Effectively, the illumination switch allows a person to easily turn the illumination source 3 on or off. Preferably, in the interests of ergonomics, the illumination switch is mounted to the elongated member 2 adjacent to the illumination source 3. In other embodiments it may be desirable to position the illumination switch elsewhere, such variations remaining within the scope of the present invention. In one embodiment, the switch is directly connected to the power cord 4. A user is easily able to turn the illumination source 3 on or off by finding the power cord 4 and engaging the switch. In other embodiments, the switch could instead be mounted on the tabletop 13 or another surface of the present invention.

Figure 1:
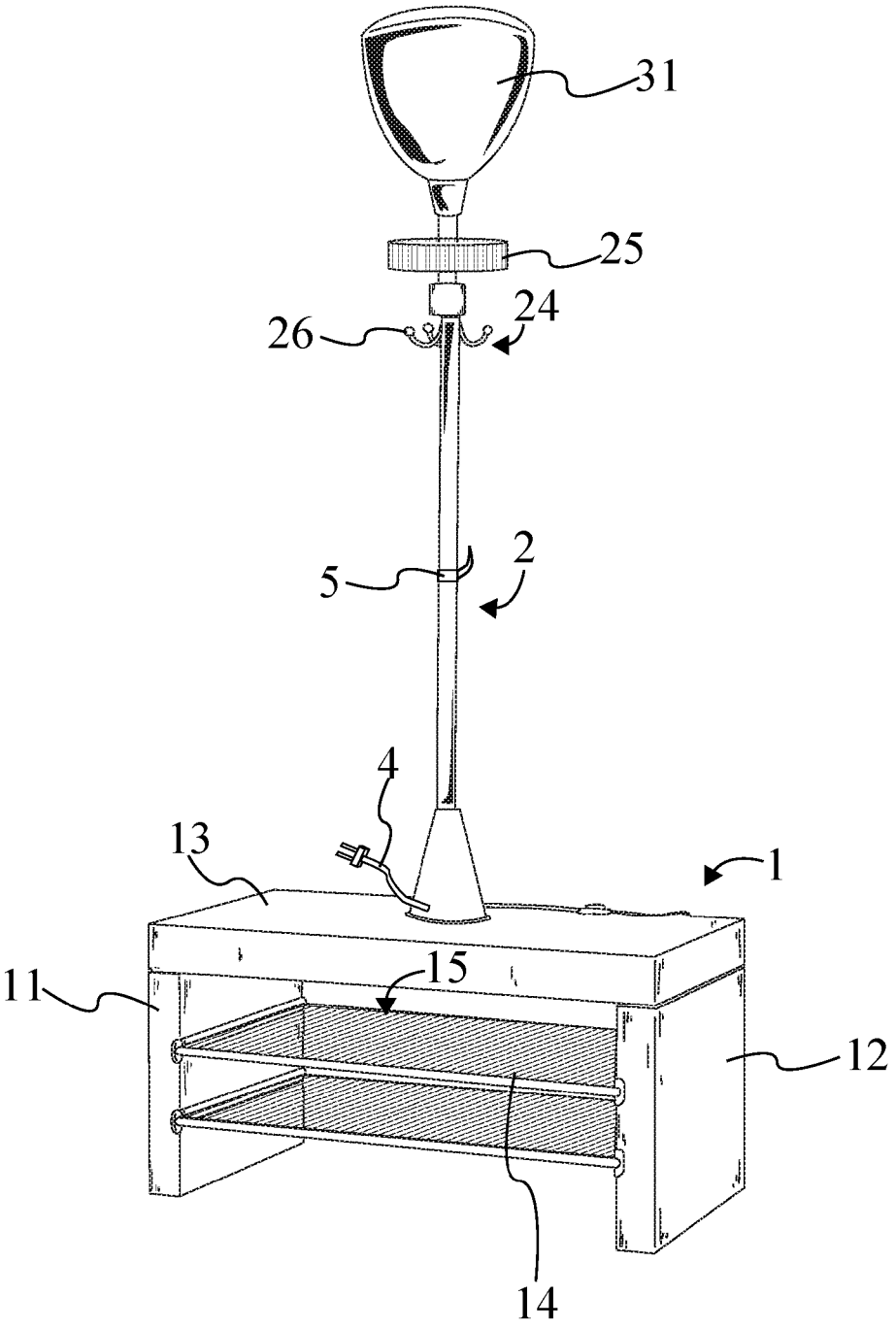
FIG. 1 is a perspective view of the present invention.
Figure 2:
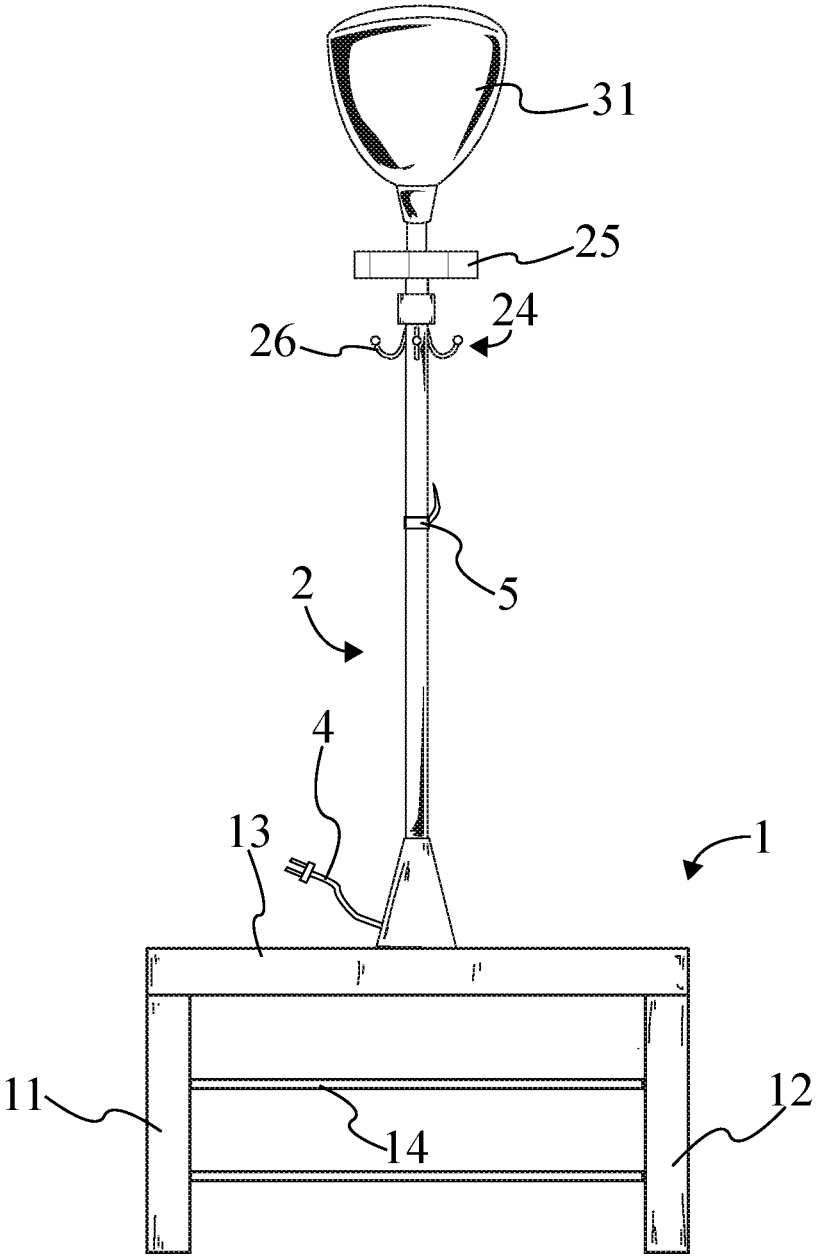
FIG. 2 is a front view of the present invention.
Figure 3:
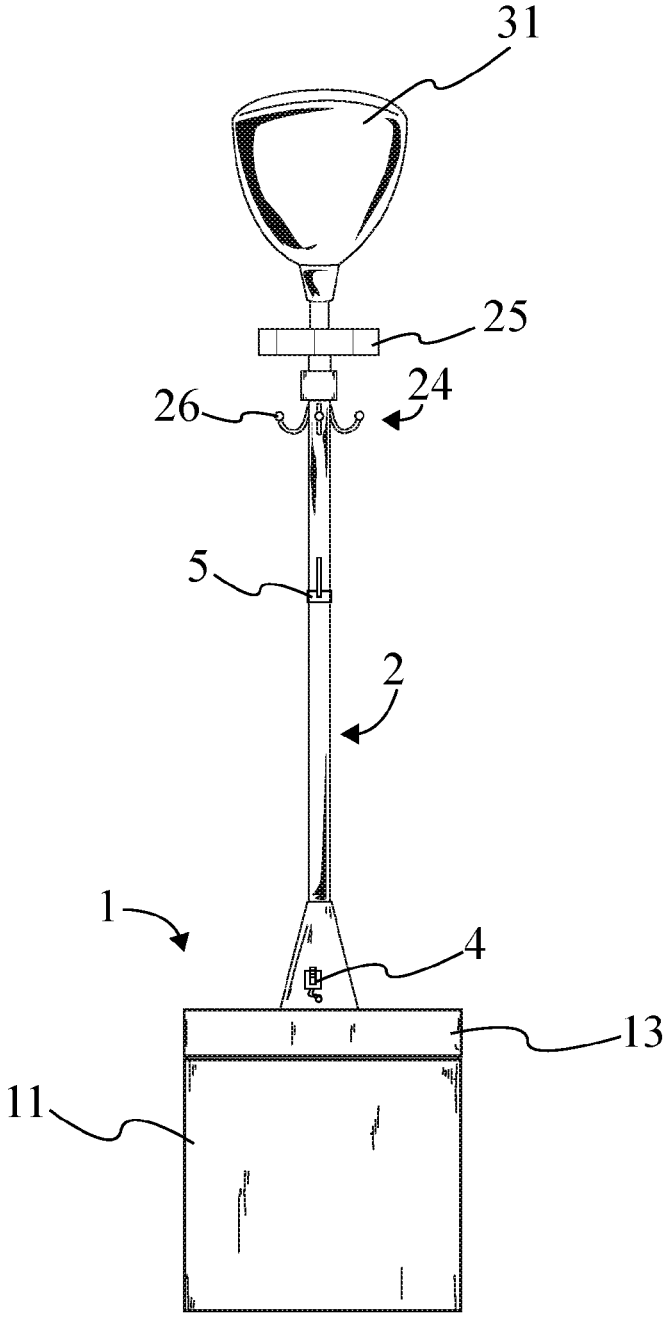
FIG. 3 is a side view of the present invention.
Figure 4:
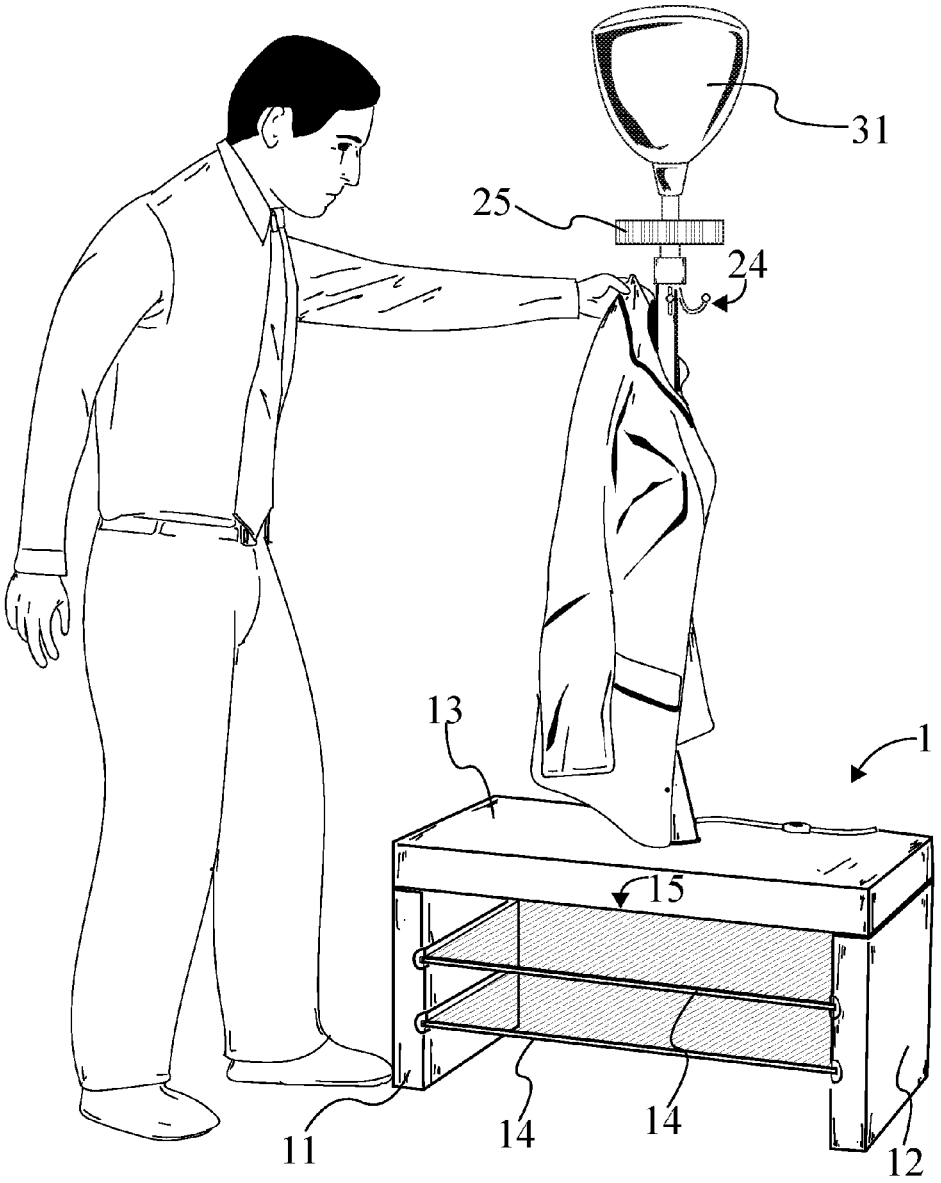
FIG. 4 is an illustration showing a user hanging a coat from the present invention.
Figure 5:
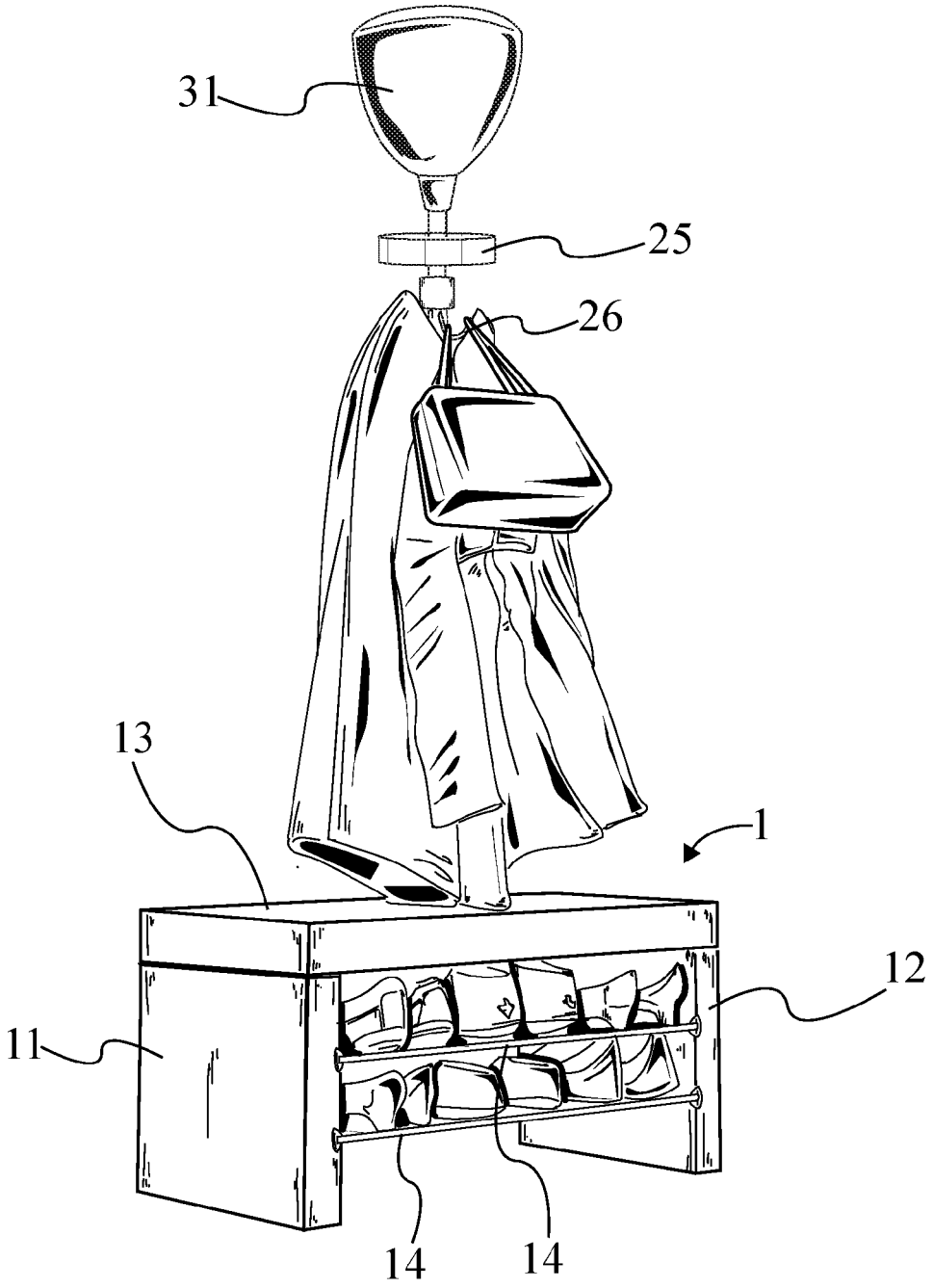
FIG. 5 is an illustration showing how the present invention is used to store a variety of items.
Figure 6:
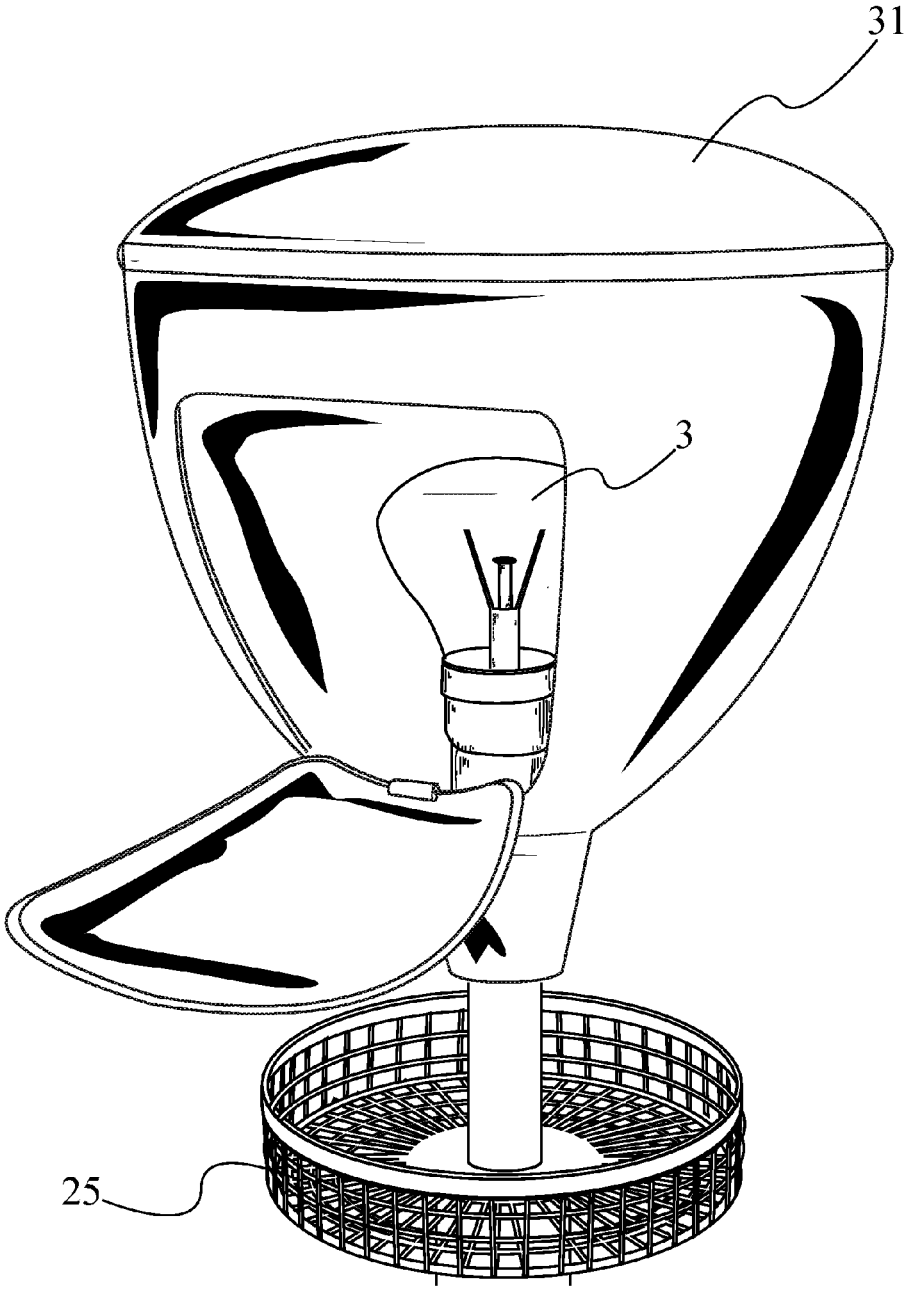
FIG. 6 is an illustration showing an illumination source of the present invention.

Along with the illumination source 3, a cover can be provided for the illumination source 3. The present invention thus comprises a lampshade 31 which is adjacently connected to the elongated member 2. Furthermore, the illumination source 3 is laterally enclosed by the lampshade 31. The lampshade 31 may comprise a door or similar access mechanism, such as seen in FIG. 6, that allows the illumination source 3 to be fully enclosed during normal operation. If the illumination source 3 needs to be accessed, the door is opened to allow for the illumination source 3 to be replaced, adjusted, or otherwise serviced.

While the at least one shelf 14 can be used to support any type of item, in the preferred embodiment the at least one shelf 14 is provided to support footwear. As footwear often becomes wet due to various reasons such as rain and dew, the ability to enhance drying of objects on the at least one shelf 14 is desirable. Thus, in the preferred embodiment, a plurality of perforations 15 traverses through the at least one shelf 14. The plurality of perforations 15 is patterned across the shelf 14, allowing for moisture to drain away from the at least one shelf 14. This prevents moisture from pooling on the at least one shelf 14, which would inhibit drying.

As mentioned, the at least one shelf 14 is not limited to storage of footwear. Umbrellas, for example, could be placed on the at least one shelf 14, with the plurality of perforations 15 allowing for drying of umbrellas similar to drying of shoes. Potentially, items that do not need to dry (such as books) can also be placed on the at least one shelf 14; overall, the present invention does not restrict what a person chooses to place on the at least one shelf 14. In the interests of increased storage capacity, two or more shelves 14 can be implemented with the present invention, as shown in the accompanying figures.

Potentially, the elongated member 2 can be made to be adjustable. To enable this, the elongated member 2 comprises a sleeve 21 and a post 22. The sleeve 21 is adjacently connected to the tabletop 13, while the post 22 is slidably engaged with the sleeve 21. The post 22 is inserted into the sleeve 21, axially traversing into said sleeve 21 in order to create a telescoping elongated member 2. To allow for a user to select a desired height, a locking mechanism 5 is mounted to the sleeve 21 and is selectively engaged with the post 22. A user can engage or disengage the locking mechanism 5 in order to prevent or allow movement of the post 22 relative to the sleeve 21. The present invention is not restricted to a specific type of locking mechanism 5.

For example, in one embodiment the locking mechanism 5 is a collar clamp that can be tightened to lock the post 22 in place or loosened to allow for movement of the post 22. In another embodiment, the locking mechanism 5 is a pin lock; a first hole laterally traverses into the sleeve 21, while a plurality of holes traverses into and is linearly patterned along the sleeve 21. A user can adjust the height of the elongated member 2 by moving the post 22 such that one of the plurality of holes is aligned with the first hole. A pin can then be inserted through the selected hole and the first hole in order to lock the post 22 in place. Yet another example is the utilization of a twist lock mechanism. These are just a few examples of possible alternative locking mechanisms 5; further implementations remain possible within the scope of the present invention.

To provide further utility for a user, the present invention may comprise a recessed compartment. The recessed compartment laterally traverses into the elongated member 2. The result is a pocket within the recessed compartment, in which small items may be placed.

Also enhancing storage capacity, the present invention may comprise an at least one protrusion 24. The at least one protrusion 24 is laterally attached about the elongated member 2, where it allows items to be suspended from the present invention. For example, in the preferred embodiment, the at least one protrusion 24 is a hook 26 that can hold a variety of items, common examples including coats, hats, and scarves.

Continuing with the theme of storage capacity, the present invention may comprise an accessory receptacle 25. The accessory receptacle 25 is laterally attached to the elongated member 2, where it serves as another platform for storage. In the preferred embodiment the accessory receptacle 25 is a basket, which the elongated member 2 axially traverses through. Similar to the recessed compartment, the accessory receptacle 25 allows for a variety of items, a few examples including keys, cards, and phones) to be stored.

To allow for further accessory items to be joined to the present invention, it is possible for accessory receiving mounts to be positioned along the elongated member 2. These mounts could be nubs or magnets, for example, that allow compatible accessories (e.g. with a slot or magnetic surface) to be attached to the elongated member 2. The ability to attach further accessories is in line with the present invention's aim to provide a compact multipurpose furniture piece. Such additions can enhance the utility of the present invention beyond that provided by the base 1 structure and the elongated member 2.

Figure 9:
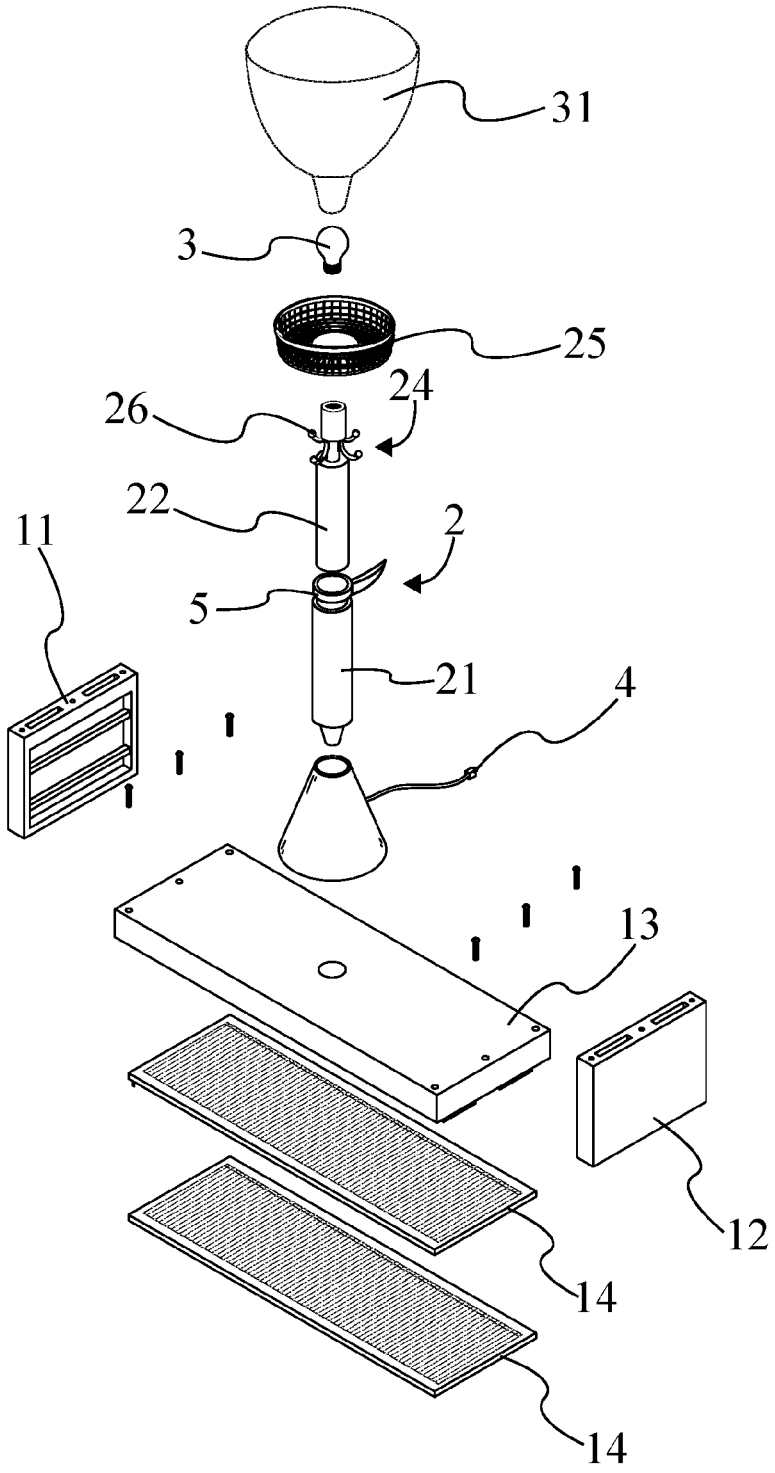
FIG. 9 is an exploded view showing how a variant design of the present invention can be assembled from individual pieces.

It is noted that the present invention is preferably easily assembled by an individual without requiring uncommon tools or abilities. Each component of the present invention can be provided to customers separately and assembled by a customer at a desired location. To facilitate this, threaded connections, fasteners, inserts, and further pieces can be provided to allow for individual components of the present invention to be attached and detached from each other. FIG. 9 shows separated pieces of a variant design of the present invention that can be assembled into one unit by a user.

Although the invention has been explained in relation to its preferred embodiment, it is to be understood that many other possible modifications and variations can be made without departing from the spirit and scope of the invention as hereinafter claimed.

What is claimed is:

1. A compact multipurpose furniture piece comprising:

a base;

the base comprising a first leg structure, a second leg structure, a tabletop, and an at least one shelf;

an elongated member;

an illumination source;

the elongated member being connected adjacent and normal to the tabletop;

the illumination source being adjacently attached to the elongated member;

the illumination source being positioned opposite the tabletop along the elongated member;

the first leg structure being adjacently connected to the tabletop;

the second leg structure being adjacently connected to the tabletop;

the elongated member being positioned opposite the first leg structure and the second leg structure through the tabletop;

the first leg structure and the second leg structure being positioned opposite each other along the tabletop;

the at least one shelf being connected between the first leg structure and the second leg structure;

the at least one shelf and the tabletop being offset from each other;

a lampshade;

the lampshade being adjacently connected to the elongated member;

the illumination source being laterally enclosed by the lampshade;

the lampshade comprising a lateral opening and a door corresponding to the lateral opening;

the door being capable of being selectively closed or open with respect to the lateral opening;

the elongated member comprising a sleeve and a post;

the post axially traversing into the sleeve;

the sleeve being adjacently connected to the tabletop;

the sleeve being slidably engaged into the post;

a locking mechanism;

the locking mechanism being adjacently mounted to the sleeve;

the locking mechanism being selectively engaged with the post;

an accessory receptacle;

the accessory receptacle being laterally attached to the elongated member;

the accessory receptacle being a basket; and the elongated member axially traversing through the accessory receptacle.

2. The compact multipurpose furniture piece as claimed in claim 1 comprises:

a power cord;

the power cord being traversing into the elongated member; and the power cord being electrically connected to the illumination source.

3. The compact multipurpose furniture piece as claimed in claim 1 comprises:

a plurality of perforations;

the plurality of perforations traversing through the at least one shelf; and the plurality of perforations being distributed across the at least one shelf.

4. The compact multipurpose furniture piece as claimed in claim 1 comprises:

an at least one protrusion; and the at least one protrusion being laterally attached about the elongated member.

5. The compact multipurpose furniture piece as claimed in claim 4 comprises:

the at least one protrusion being a hook.

* * * * *